US009271566B1

(12) United States Patent
Belge-Barnes

(10) Patent No.: US 9,271,566 B1
(45) Date of Patent: Mar. 1, 2016

(54) TOOTHBRUSH HAVING INTEGRATED FLASHLIGHT

(71) Applicant: Ginger Belge-Barnes, East Syracuse, NY (US)

(72) Inventor: Ginger Belge-Barnes, East Syracuse, NY (US)

( * ) Notice: Subject to any disclaimer, the term of this patent is extended or adjusted under 35 U.S.C. 154(b) by 0 days.

(21) Appl. No.: 14/460,044

(22) Filed: Aug. 14, 2014

(51) Int. Cl.
*A46B 15/00* (2006.01)
*A46B 9/04* (2006.01)

(52) U.S. Cl.
CPC ..... *A46B 15/0036* (2013.01); *A46B 9/04* (2013.01)

(58) Field of Classification Search
CPC .. A61C 1/088; A46B 15/002; A46B 15/0036; Y10S 362/804
See application file for complete search history.

(56) References Cited

U.S. PATENT DOCUMENTS

| | | | | |
|---|---|---|---|---|
| 5,160,194 | A * | 11/1992 | Feldman | 362/109 |
| 5,673,451 | A * | 10/1997 | Moore et al. | 15/105 |
| 5,813,855 | A | 9/1998 | Crisio | |
| 6,026,828 | A * | 2/2000 | Altshuler | 132/311 |
| 8,079,109 | B2 | 12/2011 | Misner | |
| 8,561,244 | B2 | 10/2013 | Nanda | |
| 2008/0060154 | A1 | 3/2008 | Jansheski | |
| 2008/0196184 | A1 | 8/2008 | Mary T. | |

* cited by examiner

*Primary Examiner* — Shay Karls
(74) *Attorney, Agent, or Firm* — The Keys Law Firm PLLC

(57) ABSTRACT

An illuminating toothbrush for illuminating the inside of a users mouth while the user brushes her teeth and/or gums. The illuminating toothbrush comprises a conventional toothbrush having elongated handle portion and bristle head portion modified with a lighting element connected to an internal battery compartment and a manually actuated momentary switch. The lighting element is positioned on the handle portion to enable it to direct light towards the bristle head, configuring it to illuminate the mouth of a user when the bristle head is in the user's mouth. In operation, when the manual switch is depressed through the application of manual pressure, the lighting element illuminates and when the manual pressure is removed, the lighting element ceases to illuminate.

3 Claims, 2 Drawing Sheets

TOOTHBRUSH HAVING INTEGRATED FLASHLIGHT

BACKGROUND OF THE INVENTION

1. Field of the Invention

This invention relates generally to an oral hygiene apparatus and, more particularly, to a toothbrush having an integrated flashlight for illuminating inside the mouth.

2. Description of the Prior Art

The use of elongated oral hygiene apparatus, such as a toothbrush, to clean the teeth of gums of an individual is well known. A conventional toothbrush commonly consists of an elongated handle having a head portion defined by a plurality of tightly clustered bristles which are used to brush against ones teeth and gums. A problem which still exists, however, is that when using a conventional toothbrush to brush teeth, a lack of illumination inside the mouth often makes it difficult for the user to see inside their mouth while brushing. Thus, there remains a need for a toothbrush having an integrated lighting element that would enable a user to illuminate inside their mouth while brushing. It would be helpful if such an illuminating toothbrush included an onboard power source to provide electrical power the lighting element. It would be additionally desirable for such an illuminating toothbrush included a momentary actuating switch mounted thereon that enabled a user to selectively activate the lighting element while holding the toothbrush in a conventional manner with either hand.

The Applicant's invention described herein provides for an illuminating toothbrush adapted to allow a user to activate an integrated lighting element that improves visibility in their mouth. The primary components in Applicant's illuminating toothbrush are a toothbrush, a lighting element, an actuating switch, and a power source. When in operation, the illuminating toothbrush enables more effective and efficient cleaning of a teeth and gums by providing illumination in the mouth. As a result, many of the limitations imposed by prior art structures are removed.

SUMMARY OF THE INVENTION

An illuminating toothbrush for illuminating the inside of a users mouth while the user brushes her teeth and/or gums. The illuminating toothbrush comprises a conventional toothbrush having elongated handle portion and bristle head portion modified with a lighting element connected to an internal battery compartment and a manually actuated momentary switch. The lighting element is positioned on the handle portion to enable it to direct light towards the bristle head, configuring it to illuminate the mouth of a user when the bristle head is in the user's mouth. In operation, when the manual switch is depressed through the application of manual pressure, the lighting element illuminates and when the manual pressure is removed, the lighting element ceases to illuminate.

It is an object of this invention to provide a toothbrush having an integrated lighting element that would enable a user to illuminate inside their mouth while brushing. It would be helpful if such an illuminating toothbrush included an onboard power source to provide electrical power the lighting element.

It is another object of this invention to provide an illuminating toothbrush having an onboard power source to provide electrical power the lighting element.

It is yet another object of this invention to provide an illuminating toothbrush having a momentary actuating switch mounted thereon that enabled a user to selectively activate the lighting element while holding the toothbrush in a conventional manner with either hand.

These and other objects will be apparent to one of skill in the art.

DETAILED DESCRIPTION OF THE INVENTION

Figure 1:
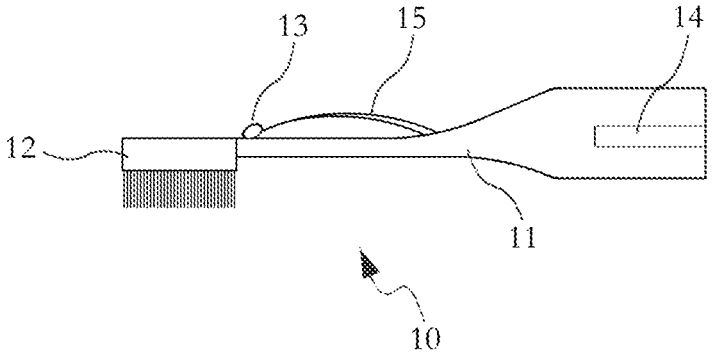
FIG. 1 is a side elevational view of an illuminating toothbrush built in accordance with the present invention having manual actuator disengaged.
Figure 2:
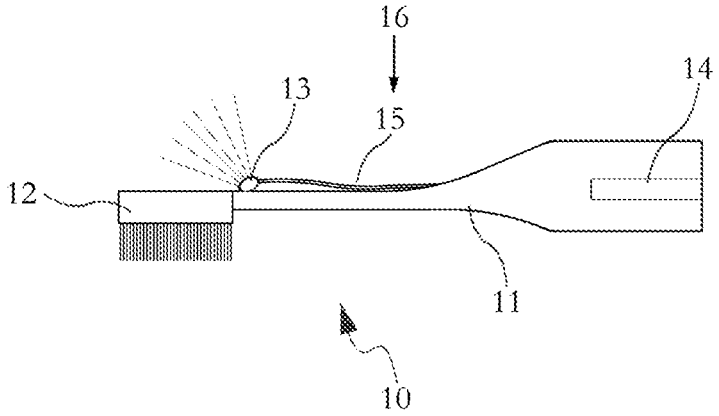
FIG. 2 is a side elevational view of an illuminating toothbrush built in accordance with the present invention having manual actuator engaged.

Referring now to the drawings and in particular FIGS. 1 and 2, an illuminating toothbrush 10 is shown having an elongated handle portion 11, bristle head portion 12, a lighting element 13, a battery compartment 14, and a manual switch 15. The handle portion 11 and the bristle head portion 12 define conventional toothbrush components and can be constructed in any conventional shape, bristle textures, sizes, and forms in accordance with the present invention. It is understood that a selected shape, bristle texture, size, and form of the handle portion 11 and/or the bristle head portion 12 will be based on the intended conventional use of the toothbrush (i.e. age of user, mouth size, etc).

The lighting element 13 is defined in the preferred embodiment as an LED light and is mounted on the handle portion 11 of the illuminating toothbrush 10 on the opposite side of the side the bristles extend from the bristle head 12. The lighting element 13 is positioned to direct light towards the bristle head 12 so as to illuminate the mouth when the bristle head 12 is in a user's mouth and, more specifically, area of the mouth where the user is brushing.

The lighting element 13 electrically connected to the battery compartment 14 through a wire (not shown) that runs internally through the handle portion 11. In this regard, the lighting element 13 selectively receives electricity from a battery (not shown) contained in the battery compartment 14. When electricity is supplied from the battery, the lighting element 13 illuminates in the same manner as conventional LED lights.

The manual switch 15 is defined as a momentary switch that allows a user to selectively provide electricity from the battery in the battery compartment 14 to the lighting element 13. In this regard, when the manual switch is depressed through the application of manual pressure in an actuating direction 16, a circuit is formed allowing electricity from the battery to flow to the lighting element 13, thereby causing the lighting element to illuminate. When the manual pressure in the actuating direction 16 is removed, the circuit is broken and the lighting element 13 ceases to illuminate.

It is contemplated that the placement of the manual switch 15 on the back of the handle portion 11 makes it positioned to be easily depressed by a user holding the handle portion 11 with either hand as it is located where the user's index finger would normally go anyway when holding a toothbrush.

In the preferred embodiment, the illuminating toothbrush 10 measures either six (6) or eight (8) inches long and employs a removable battery. In one embodiment, the illuminating toothbrush 10 employs a rechargeable battery and additionally includes an electrical port for receiving electricity from a conventional electrical cord and plug.

It is contemplated that in addition to being used on humans, the illuminating toothbrush can be used on animals, such as dogs.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An illuminating toothbrush, comprising:

a toothbrush body having a front exterior side and back exterior side and defined by an elongated handle portion adjacent to a bristle head portion, wherein said toothbrush body includes a neck in between the handle portion and bristle head portion and said bristle head portion includes a plurality of bristles extending from the front exterior side;

a lighting element positioned on the neck and disposed on the back exterior side of the toothbrush body, wherein said lighting element is configured to illuminate when supplied with electricity;

an internal battery compartment adapted to receive a battery, wherein said lighting element and said internal battery compartment are electrically connected to enable electricity in a battery disposed in the internal battery compartment to be selectively directed to the lighting element; and a manually actuated momentary switch disposed on the back exterior side of said toothbrush body, wherein said momentary switch is configured to enable electricity in a battery disposed in the internal battery compartment to be directed to the lighting element.

2. The illuminating toothbrush of claim 1, wherein said momentary switch is disposed on said handle portion, thereby enabling it to be actuated by a user's index finger while the user is grasping handle portion.

3. The illuminating toothbrush of claim 1, wherein the momentary switch is positioned adjacent to the lighting element.

* * * * *